US010850895B2

(12) United States Patent
Aubret et al.

(10) Patent No.: US 10,850,895 B2
(45) Date of Patent: Dec. 1, 2020

(54) CLOSURE CAP

(71) Applicant: L'Oreal, Paris (FR)

(72) Inventors: Kerem Aubret, Clichy (FR); Patrick Charnay, Clichy (FR); Raphaël Menetrat, Clichy (FR)

(73) Assignee: L'Oreal, Paris (FR)

( * ) Notice: Subject to any disclaimer, the term of this patent is extended or adjusted under 35 U.S.C. 154(b) by 38 days.

(21) Appl. No.: 16/326,868

(22) PCT Filed: Sep. 5, 2017

(86) PCT No.: PCT/EP2017/072176
§ 371 (c)(1),
(2) Date: Feb. 20, 2019

(87) PCT Pub. No.: WO2018/046472
PCT Pub. Date: Mar. 15, 2018

(65) Prior Publication Data

US 2019/0193902 A1 Jun. 27, 2019

(30) Foreign Application Priority Data

Sep. 8, 2016 (FR) ..... 16 58358

(51) Int. Cl.
*B65D 47/08* (2006.01)

(52) U.S. Cl.
CPC ..... *B65D 47/0814* (2013.01)

(58) Field of Classification Search
CPC ..... B65D 47/0814
(Continued)

(56) References Cited

U.S. PATENT DOCUMENTS 4,047,495 A * 9/1977 O'Brian ..... B65D 47/0814 215/224
4,346,810 A 8/1982 Kneissl
(Continued)

FOREIGN PATENT DOCUMENTS

JP S573636 A 1/1982
JP S63144457 A 9/1988
(Continued)

OTHER PUBLICATIONS

International Search Report issued in corresponding PCT/EP2017/072176 filed Sep. 5, 2017, dated Jul. 11, 2017, 3 pages.

*Primary Examiner* — James N Smalley
(74) *Attorney, Agent, or Firm* — Christensen O'Connor Johnson Kindness PLLC

(57) ABSTRACT

Closure cap intended to close off an open end of a reservoir, comprising a substantially cylindrical body (12) of longitudinal axis (Z) that is intended to be mounted on the open end of the reservoir and is provided with a flow orifice (12*e*) and a lid (14) that is articulated about a transverse pivot axis (A0) with respect to the body (12), by means of at least two hinges (16), between an open position of the flow orifice (12*e*) and a closed position of said flow orifice (12*e*), said lid (14) having an outside diameter greater than the outside diameter of the body (12) and forming a radial lip, said closure cap (10) also comprising a return member (18) that is disposed in a plane passing between the two hinges (16) and is able to keep the lid (14) in each of the positions. The return member (18) has a bent shape configured to be inserted into cavities (12*f*, 14*d*) made in the body (12) and in the lid (14), respectively, and to be flush with the radial lip of the lid (14) in the closed position.

11 Claims, 5 Drawing Sheets

(58) Field of Classification Search
USPC ..... 220/254.3, 254.5; 215/235, 237; 222/556
See application file for complete search history.

(56) References Cited

U.S. PATENT DOCUMENTS

| | | | | | |
|---|---|---|---|---|---|
| 4,386,714 | A * | 6/1983 | Roberto | B65D 47/0814 | 215/235 |
| 5,169,035 | A * | 12/1992 | Imbery, Jr. | B65D 47/0814 | 222/212 |
| 5,573,127 | A * | 11/1996 | Takahashi | B65D 47/0814 | 215/237 |
| 2002/0148802 | A1 * | 10/2002 | Takahashi | B65D 47/0814 | 215/237 |
| 2006/0013737 | A1 * | 1/2006 | Giusti | B01L 3/50825 | 422/400 |
| 2008/0023477 | A1 * | 1/2008 | Marked | B65D 47/0814 | 220/259.1 |
| 2008/0245795 | A1 * | 10/2008 | Berge | B65D 47/0814 | 220/264 |

FOREIGN PATENT DOCUMENTS

| | | | |
|---|---|---|---|
| JP | H07315404 | A | 12/1995 |
| JP | H107163 | A | 1/1998 |

* cited by examiner

CLOSURE CAP

The present invention relates to the field of closure caps or plugs that are intended to close off the opening in a bottle containing a fluid, for example a cosmetic product.

The term "cosmetic product" is understood, in particular within the meaning of the present invention, to mean a product as defined in Regulation (EC) No 1223/2009 of the European Parliament and Council of 30 Nov. 2009 relating to cosmetic products.

More particularly, the present invention relates to closure caps made of synthetic material comprising a hollow cylindrical body that is intended to be fastened to the open end of the bottle to be closed off, and a lid that is articulated on the body between an open position opening the bottle and a closed position closing said bottle.

Generally, the lid is articulated with respect to the body by means of two hinges or articulations.

In this regard, reference may be made to the document FR 2 007 294-A1 (Lenox-Werk), which describes an articulation made of synthetic material forming a hinge for connecting a container made of synthetic material to a lid.

Conventionally, a closure cap also comprises a return member that is disposed between the body of the cap and the lid and is produced in the form of a lug made of synthetic material which has the function of elastically returning the lid from its open position to its closed position and vice versa.

Reference may be made, for example, to the document EP 0 447 357-B1 (Createchnic AG), which describes a plug made of plastics material having a body, a top articulated with respect to the body by means of two hinges, and an S-shaped flexible element which is fastened to the body and to a lateral face of the top and is configured to confer a spring effect on the lid.

However, in the closed position of the lid, the elastic element forming a spring has gaps in which external contaminating particles can collect.

Reference may also be made to the document U.S. Pat. No. 4,487,324 (Ostrowsky) or EP 0 141 591-B1 (Johnsen & Jorgensen), which describe a closure plug made of plastics material having a substantially cylindrical body and a lid that has a diameter identical to the diameter of the body and is articulated by means of two hinges and an L-shaped toggle or return member with respect to the body between an open position and a closed position in which the lid rests on the body.

Also known is a particular example of a closure cap comprising a cap body that is provided with an annular collar with an outside diameter greater than the outside diameter of said body and comprises a lid that is articulated on said annular collar by means of two hinges between an open position and a closed position in which the lid bears against the annular collar. The cap also comprises a return member of which one end is fastened to the body and a second end is fastened to the lid. In the closed position, the return member is inserted into a housing made in the lid and in the annular collar.

However, in this closed position, the contour of such a cap is interrupted by the housing made in the annular collar, creating cavities into which external contaminating particles, notably dust, sand etc., can pass. The presence of external particles in these cavities can prevent correct closure of the lid on the cap body, that is to say complete closure of the lid.

In addition, during the transport of such a closure cap, in the closed position, the hinges are exposed and are prone to damage.

Therefore, the object of the invention is to remedy the above drawbacks and to avoid early deterioration of a closure cap, notably of the articulations, in the particular case in which the lid of the closure cap has an outside diameter greater than the outside diameter of the body of the cap.

The subject of the invention is a closure cap intended to close off an open end of a reservoir, comprising a substantially cylindrical body of longitudinal axis that is intended to be mounted on the open end of the reservoir and is provided with at least one flow orifice, and a lid that is articulated about a transverse pivot axis with respect to the body, by means of at least two hinges, between an open position of the flow orifice and a closed position of said orifice. Said lid has an outside diameter greater than the outside diameter of the body and forming a radial lip. Said closure cap also comprises a return member that is disposed in a plane passing between the two hinges and is able to keep the lid in each of the open and closed positions.

The return member has a bent shape configured to be inserted into cavities made in the body and in the lid, respectively, and to be flush with the radial lip of the lid in the closed position, in the region of the hinges.

Thus, this design of the return member allows the cap to have a perimeter without a radial recess in the region of the hinges. In addition, the substantially continuous perimeter of the cap in the closed position makes it possible to avoid the accumulation of contaminating materials in this region of the hinges.

Advantageously, the return member comprises a first articulation part that is deformable about a first transverse articulation axis and is connected to the periphery of the body, a second articulation part that is deformable about a second transverse articulation axis and is connected to the outer surface of the lid, and at least two legs that extend between the articulation parts and are at an angle to one another, the return member having a flexion axis between said legs.

Thus, in the open position, the flexion axis is spaced apart from the body, thereby making it possible, in the closed position, for the return member to match the shape of the annular skirt of the lid and thus for there to be a continuous perimeter of the closure cap in the closed position.

According to a first embodiment, the first articulation part is extended by a first leg, a second leg that is at an angle to the first leg, a third leg that is at an angle to the second leg, and a fourth and a fifth leg that extend towards the lid, said fifth leg being connected to the second articulation part.

In the open position, the second leg extends, for example, downwards at 90° to the first leg and the fifth leg extends, for example, downwards at 45° to the surface of the lid.

According to a second embodiment, the first articulation part is extended by a first leg and a second leg that is at an angle to the first leg and is connected to the second articulation part.

Advantageously, the first leg has two side walls in order to locally create, at the junction with the second leg, an increase in material. The side walls allow the return member not to be deformable, while retaining the spring effect of the return member.

In the open position, the second leg extends, for example, towards the lid at 90° to the first leg.

The body may comprise an annular collar with an outside diameter greater than the outside diameter of the body and less than the outside diameter of the lid, the lid radially surrounding said collar in the closed position.

Each hinge is produced, for example, in the form of a strip, the thickness of which is reduced at the pivot axis, in order to confer elastic properties on the hinges.

Advantageously, the closure cap is produced in one piece by injection-moulding a plastics material, for example a polymer such as polypropylene.

According to a second aspect, the invention relates to a device for packaging and dispensing a product, notably a cosmetic product, comprising a reservoir that delimits a housing containing said product and is provided with a neck on which a closure cap as described above is mounted.

Further aims, features and advantages of the invention will become apparent from reading the following description, which is given only by way of non-limiting example and with reference to the appended drawings, in which.

FIGS. 1 to 5 illustrate a closure cap or plug, of overall reference 10, that is intended to shut off an open end of a reservoir (not shown) forming a neck. The reservoir may, for example, be a bottle delimiting a housing containing for example a cosmetic product or any other fluid product. The closure cap can be mounted on the neck of the reservoir by being screwed, press-fitted or by another means and this will not be described further in the rest of the description.

The closure cap 10 is produced in one piece for example by injection-moulding a plastics material, for example a polymer such as polypropylene or any other polymeric composition having similar physical properties.

Figure 1:
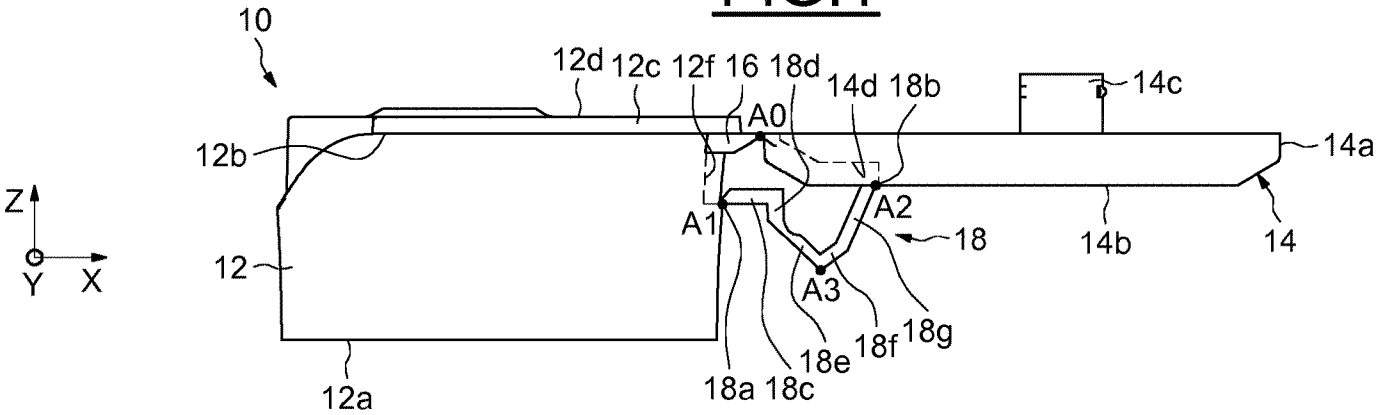
FIG. 1 shows a closure cap according to a first embodiment of the invention in an open position.
Figure 2:
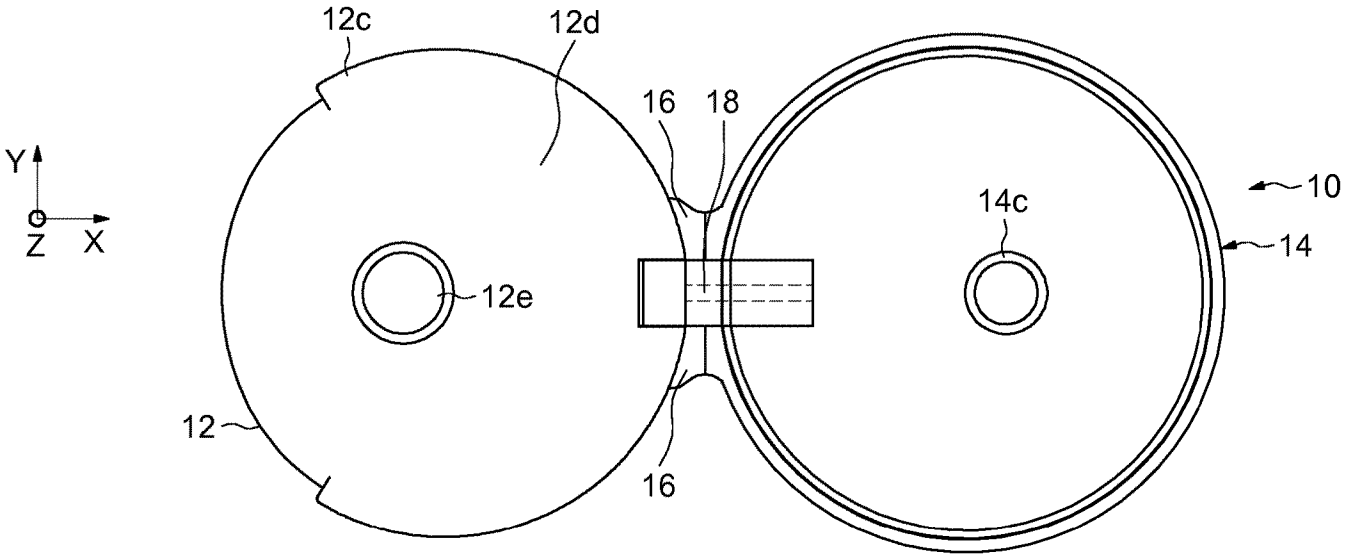
FIG. 2 is a top view of the closure cap from FIG. 1.
Figure 3:
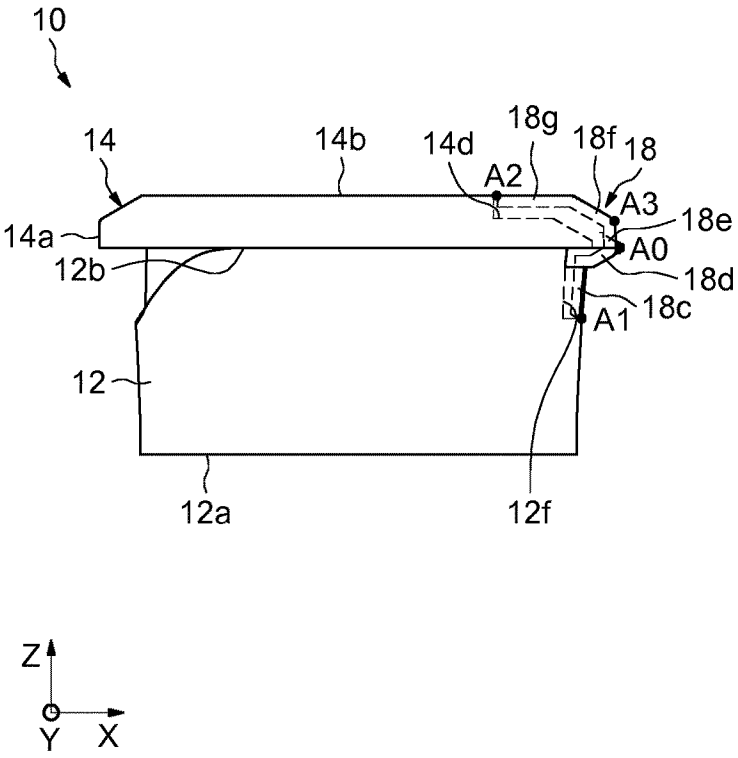
FIG. 3 shows the closure cap from FIG. 1 in a closed position.

As illustrated in FIGS. 1 to 3, the closure cap 10 comprises a substantially cylindrical body 12 that extends along a longitudinal axis Z, in this case shown in a vertical use position, and comprises an open lower end 12*a* that is intended to surround the annular neck of the reservoir and an upper end 12*b*, remote from the lower end 12*a*. The upper end 12*b* comprises a substantially annular collar 12*c* with an outside diameter greater than the outside diameter of the body 12.

The body 12 also comprises a radial upper wall 12*d* that closes the upper end 12*b* and is provided with a flow orifice 12*e* for the fluid contained in the reservoir to pass through.

In the exemplary embodiment illustrated, the flow orifice 12*e* opens out at a boss which protrudes from the upper wall 12*d*. Alternatively, provision could be made for the flow orifice 12*e* to open out at a flat upper wall or in a recessed housing formed in the upper wall 12*d*.

The closure cap 10 also has a lid 14 that is articulated with respect to the body 12 by means of two attachment lugs 16 that form articulations or hinges about a transverse pivot axis A0, along the transverse axis Y, perpendicular to the longitudinal axis Z, between an open position, visible in FIG. 1, and a closed position visible in FIG. 2. Each hinge 16 is produced in the form of a strip, the thickness of which is reduced at the pivot axis A0, in order to confer flexion properties on the hinges.

Figure 5:
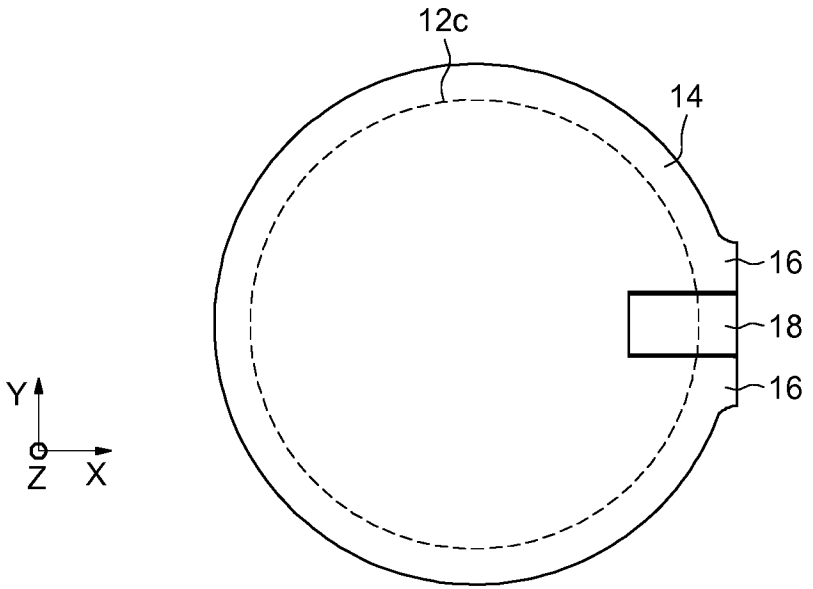
FIG. 5 is a top view of the closure cap from FIG. 3 in the closed position.

As illustrated, the lid 14 comprises an annular skirt 14*a* that is closed by a wall or top surface 14*b*. The annular skirt 14*a* has an outside diameter greater than the outside diameter of the annular collar 12*c* in order to radially surround said collar in the closed position, as can be seen in FIG. 5. The outside diameter of the annular skirt 14*a* is also greater than the outside diameter of the body 12 so as to form a radial lip which protrudes from the body 12. The lid 14 also comprises a stopper member 14*c* that protrudes axially towards the inside from the inner surface of the top surface 14*b* when the lid is in the closed position. The stopper member 14*c* is realized in this case in the form of a stud.

The open position, illustrated in FIG. 1, corresponds to an open position of the flow orifice 12*e* that allows the fluid contained in the reservoir to flow towards the outside. The closed position, illustrated in FIG. 2, corresponds to a closed position of the flow orifice 12*e* that is closed off by the stopper member 14*c*, thereby preventing the fluid contained in the reservoir from flowing towards the outside. In the closed position, the lid sits on top of and covers the radial annular collar.

In the exemplary embodiment illustrated, the annular collar 12*c* radially surrounds a part of the upper end 12*b* of the body 12. This allows the user to access the lid 14 more easily in order to articulate it into the open position. Alternatively, however, provision could be made for the annular collar 12*c* to radially surround the entire upper end 12*b* of the body 12.

The closure cap 10 also comprises a return member 18 referred to as a "toggle" or "engagement-effect device" that forms a spring intended to keep the lid 14 in each of the open and closed positions. The return member 18 thus makes it possible to have assistance for opening and closing the lid. The return member 18 is disposed in a plane that passes between the two hinges 16. The return member 18 is offset longitudinally towards the lower end 12*a* of the body with respect to the hinges 16. The return member 18 has a first articulation part 18*a* that is deformable about a first transverse articulation axis A1 and is connected to the periphery of the body 12 in the plane passing between the two hinges 16 and offset longitudinally towards the lower end 12*a* of the body with respect to the hinges 16.

The return member 18 also has a second articulation part 18*b* that is deformable about a second transverse articulation axis A2 and connected to the outer surface of the top surface 14*b* of the lid 14. The first end part 18*a* is extended by a first leg 18*c* that is substantially inclined with respect to a horizontal axis X, orthogonal to Y and Z, and then by a second leg 18*d* that extends downwards at 90° to the first leg 18*c*. The second leg 18*d* is extended by a third leg 18*e* that is inclined with respect to the axis of the second leg 18*d*, and then by a fourth and a fifth leg 18*f*, 18*g* that extend towards the lid 14. The articulation parts 18*a*, 18*b* have a cross section that is thinner than the cross section of the legs 18*c*, 18*d*, 18*e*, 18*f* and 18*g*.

The particular bent shape of the return member 18 makes it possible to have a plurality of pivot axes A1, A2 and A3. The pivot axes A1, A2 and A3 are mutually parallel and parallel to the pivot axis A0. The flexion point of the return member is situated at the third pivot axis A3.

Thus, the return member 18 is configured to be inserted into cavities 12*f*, 14*d* made in the body 12 and in the lid 14, respectively, in the closed position, allowing the cap to have a perimeter without a radial recess at the articulation 16. In other words, the bent shape of the return member 18 matches the annular skirt in the closed position so as to be flush with the radial lip of the annular skirt 14*a* with respect to the body 12. The continuous perimeter of the closure cap is visible in the top view illustrated in FIG. 5. The flexion point is thus spaced apart from the body compared with the flexion point of a conventional L-shaped toggle which is located at the junction between the body and the first part, thereby allowing the return member 18 to be aligned with the annular skirt 14*a* of the lid and thus to have a perimeter of the cap that is continuous in the closed position. A continuous perimeter is understood to be a perimeter that does not have any radial recess.

Figure 4:
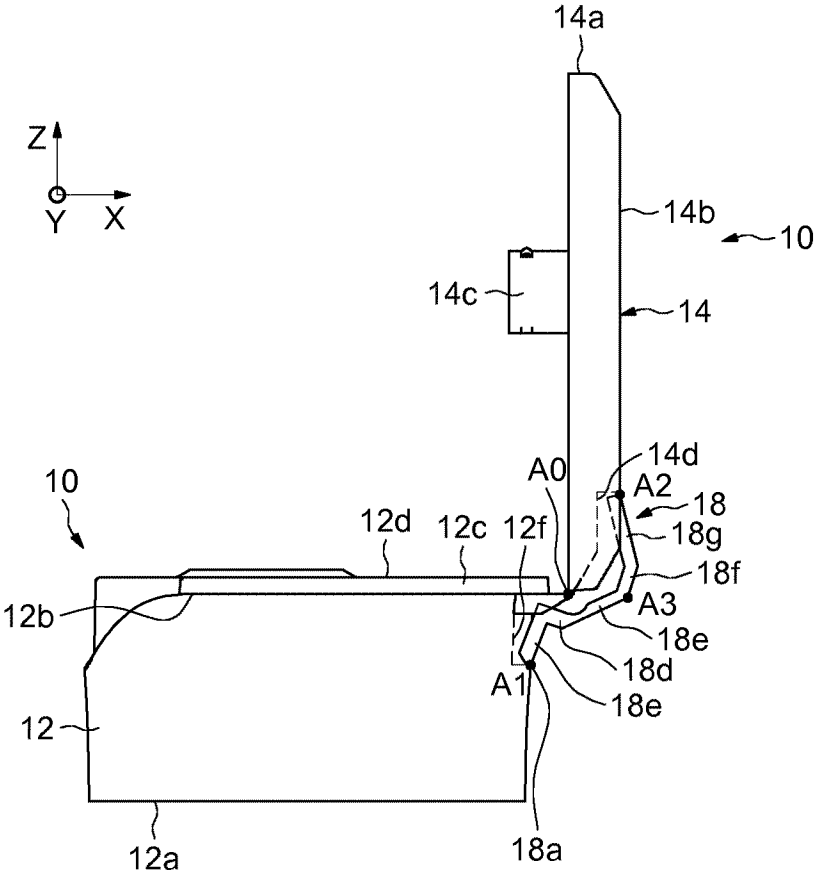
FIG. 4 shows the closure cap from FIG. 1 in an intermediate position.

The position, known as the intermediate position, visible in FIG. 4, is unstable on account of the elastic flexion about the flexion axis A3 that arises within the return member 18.

Figure 6:
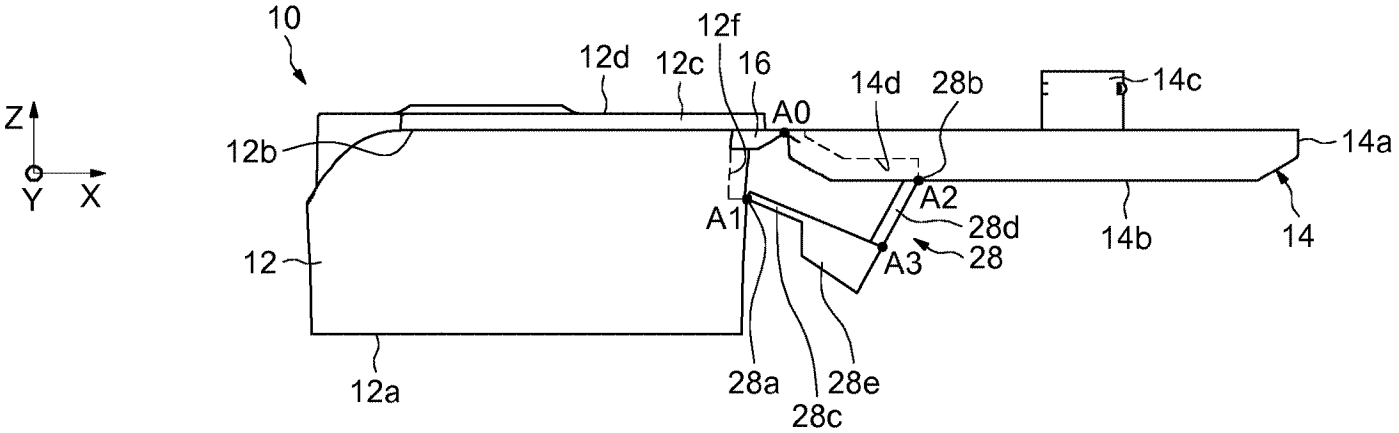
FIG. 6 shows a closure cap according to a second embodiment of the invention in an open position.
Figure 7:
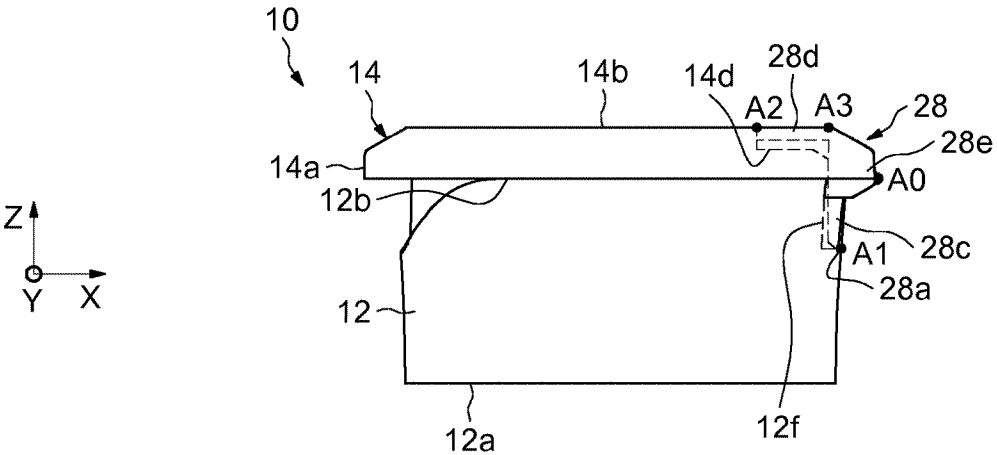
FIG. 7 shows the closure cap from FIG. 6 in a closed position.
Figure 8:
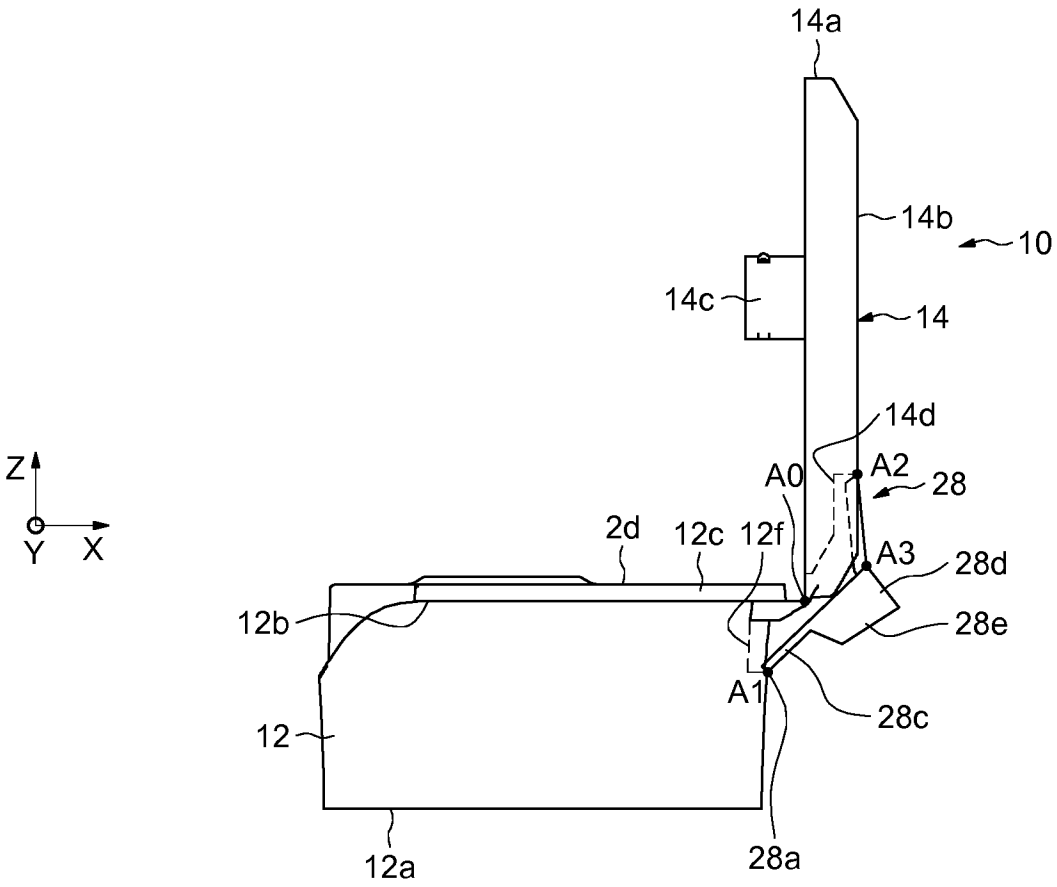
FIG. 8 shows the closure cap from FIG. 6 in an intermediate position.

The embodiment illustrated in FIGS. 6 to 8, in which identical elements bear the same references, differs from the embodiment illustrated in FIGS. 1 to 5 only by the shape of the return member.

In this embodiment, the closure cap 10 comprises a return member 28 that is disposed in a plane passing between the two hinges 16. The return member 28 has a first articulation part 28*a* that is deformable about a first transverse articulation axis A1 and connected to the periphery of the body 12 between the lower end 12*a* of the body and the hinges 16, and a second articulation part 28*b* that is deformable about a second transverse articulation axis A2 and connected to the outer surface of the top surface 14*b* of the lid 14. The first part 28*a* is extended by a first leg 28*c* that is substantially inclined with respect to the horizontal axis X, and then by a second leg 28*d* that extends towards the lid 14 at 90° to the first leg 28*c*. The first leg 28*c* has two side walls 28*e* in order to locally create, at the junction with the second leg 28*d*, an increase in material. The side walls 28*e* allow the return member not to be deformable, while retaining the spring effect of the lid. The articulation parts 28*a*, 28*b* have a cross section that is thinner than the cross section of the legs 28*c*, 28*d*.

The particular bent shape of the return member 28 makes it possible to have a plurality of pivot axes A1, A2 and A3. The flexion point of the return member is situated at the third pivot axis A3, between the first and second legs 28*c*, 28*d*.

Thus, similarly to the return member 18 illustrated with reference to the first embodiment, the return member 28 is configured to be inserted into cavities 12*f*, 14*d* made in the body 12 and in the lid 14, respectively, in the closed position.

By virtue of the particular shape of the return member, the latter matches, in the closed position, the shape of the annular skirt of the lid in order to allow a continuous contour of the annular skirt of the lid and thereby to avoid the creation of gaps in which external particles may collect.

The expression "having a" should be understood as being synonymous with the expression "having at least one", unless otherwise specified.

The invention claimed is:

1. Closure cap intended to close off an open end of a reservoir, comprising a substantially cylindrical body of longitudinal axis that is intended to be mounted on the open end of the reservoir and is provided with at least one flow orifice, and a lid that is articulated about a transverse pivot axis with respect to the body, by means of at least two hinges, between an open position of the flow orifice and a closed position of said orifice, said lid having an outside diameter greater than the outside diameter of the body and forming a radial lip, said closure cap also comprising a return member that is disposed in a plane passing between the two hinges and is able to keep the lid in each of the open and closed positions, wherein the return member has a bent shape configured to be inserted into cavities made in the body and in the lid, respectively, and to be flush with the radial lip of the lid in the closed position, said return member comprising:

a first articulation part that is deformable about a first transverse articulation axis and is connected to the periphery of the body, a second articulation part that is deformable about a second transverse articulation axis and is connected to the outer surface of the lid, and at least two legs that extend between the articulation parts and are at an angle to one another, the return member having a flexion axis between said legs.

2. Closure cap according to claim 1, wherein the first articulation part is extended by a first leg, a second leg that is at an angle to the first leg, a third leg that is at an angle to the second leg, and a fourth and a fifth leg that extend towards the lid.

3. Closure cap according to claim 2, wherein, in the open position, the second leg extends downwards at 90° to the first leg.

4. Closure cap according to claim 2, wherein, in the open position, the fifth leg extends downwards at 45° to the surface of the lid.

5. Closure cap according to claim 1, wherein the first articulation part is extended by a first leg and a second leg that is at an angle to the first leg and is connected to the second articulation part.

6. Closure cap according to claim 5, wherein the first leg has two side walls.

7. Closure cap according to claim 5, wherein, in the open position, the second leg extends towards the lid at 90° to the first leg.

8. Closure cap according to claim 1, wherein the body comprises an annular collar with an outside diameter greater than the outside diameter of the body and less than the outside diameter of the lid, the lid radially surrounding said collar in the closed position.

9. Closure cap according to claim 1, wherein each hinge is produced in the form of a strip, the thickness of which is reduced at the pivot axis.

10. Closure cap according to claim 1, which is produced in one piece by injection-moulding a plastics material.

11. Device for packaging and dispensing a product, comprising a reservoir that delimits a housing containing said product and is provided with a neck on which a closure cap according to claim 1 is mounted.

* * * * *